US007117687B2

(12) United States Patent
Naaman

(10) Patent No.: US 7,117,687 B2
(45) Date of Patent: Oct. 10, 2006

(54) PERSONAL AIR CONDITIONING

(75) Inventor: Chibbi Naaman, Reut (IL)

(73) Assignee: Micro Climate Solutions, Ltd., Reut (IL)

( * ) Notice: Subject to any disclaimer, the term of this patent is extended or adjusted under 35 U.S.C. 154(b) by 0 days.

(21) Appl. No.: 10/501,863

(22) PCT Filed: Jul. 30, 2002

(86) PCT No.: PCT/IL02/00624

§ 371 (c)(1),
(2), (4) Date: Mar. 31, 2005

(87) PCT Pub. No.: WO03/017790

PCT Pub. Date: Mar. 6, 2003

(65) Prior Publication Data

US 2005/0172655 A1 Aug. 11, 2005

(30) Foreign Application Priority Data

Aug. 23, 2001 (IL) ..... 145094

(51) Int. Cl.
*F25D 23/12* (2006.01)

(52) U.S. Cl. ..... 62/259.3; 62/3.5

(58) Field of Classification Search ..... 62/3.5, 62/259.3, 3.3
See application file for complete search history.

(56) References Cited

U.S. PATENT DOCUMENTS

| | | | | |
|---|---|---|---|---|
| 3,738,367 | A * | 6/1973 | Hardy | 607/104 |
| 3,743,012 | A | 7/1973 | Laxo | |
| 4,998,415 | A | 3/1991 | Larsen | |
| 5,002,270 | A * | 3/1991 | Shine | 482/105 |
| 5,970,519 | A * | 10/1999 | Weber | 2/81 |
| 6,178,562 | B1 | 1/2001 | Elkins | |
| 6,257,011 | B1 | 7/2001 | Siman-Tov et al. | |

* cited by examiner

*Primary Examiner*—Melvin Jones
(74) *Attorney, Agent, or Firm*—Oblon, Spivak, McClelland, Maier & Neustadt, P.C.

(57) ABSTRACT

The present invention provides air conditioning garment for air conditioning an individual wearing said garment. The garment comprises an inner layer of a three-dimensional netting structure enclosed between two layers of substantially air-impermeable fabric, wherein the layer facing the wearer's body is having a plurality of openings directed toward predetermined locations on said body. The garment is having an inlet opening with connection means for connecting the inner layer to a source of air at a predetermined temperature.

21 Claims, 4 Drawing Sheets

FIG. 2B
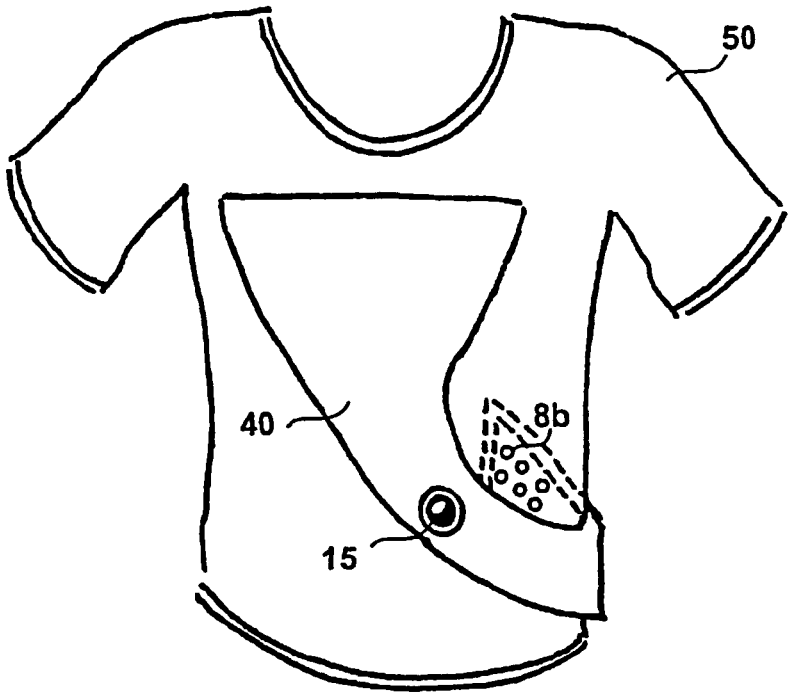
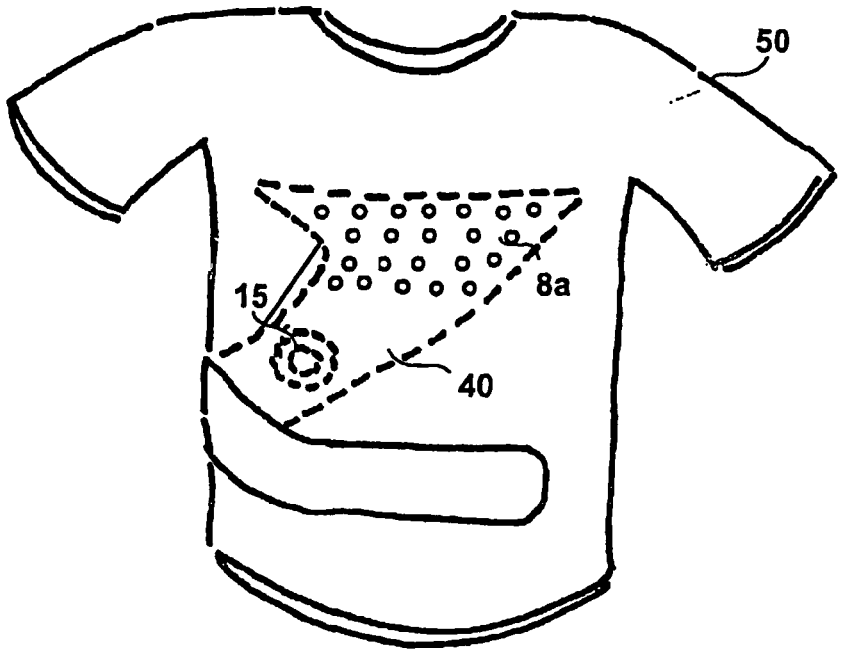
FIG. 2C

PERSONAL AIR CONDITIONING

BACKGROUND OF THE INVENTION

1. Field of the Invention

The present invention relates to air conditioning garments for individuals under extreme environmental conditions. In particular, the present invention relates to garments such as suits, vests, helmets and parts thereof, for racecar drivers, motorcycle drivers and pilots.

2. Discussion of the Related Art

In a clear day, with ambient temperature of 25 degrees Celsius, cabin temperature may reach 40 degree Celsius and more. Excess heat, when vehicle operators are not aware of their judgment being affected by the harsh conditions, seems to be the cause of numerous accidents.

The major traditional technologies used for air conditioning are air-cycle and vapor-cycle. Air-cycle air-conditioning works by the use of high-pressure air that is accelerated and allowed to expand rapidly, thus exchanging heat with surrounding area and cooling the air. This technology is used primarily for the air-conditioning of large transport aircraft and jet airplanes, where a large volume of pressurized air is available. Vapor-cycle air conditioning, which is the most common technology, exploits the use of a compressor and refrigerant liquid/gas to perform a heat exchange process with the surrounding air, thus cooling the environment.

Such traditional systems, which are used to cool an enclosed space, for instance an entire vehicle's cabin, are not fit for use in special vehicles such as closed-cockpit racecars and small aircraft because of weight and energy consumption considerations. The units used by traditional methods are heavy, in the range of 30–40 kg. This is an extensive and unacceptable added weight to a racecar or a small aircraft, which seriously impedes their performance. Standard air-conditioning units also require a large energy source, which is usually taken from the vehicle's power plant and might consume about 5% of the engine power. This is a negative factor to racecars drivers and owners, needing every bit of engine power. Thus, standard units do not fit for use in vehicles where power consumption demands may reduce performance. Furthermore, standard air-conditioning systems involve high expenses and their installation increases the burden and cost of the racecar or aircraft manufacturing.

The approach taken by the present invention is to air condition the individual rather than the environment. Such an approach fits individuals under extreme environmental conditions such as racecar drivers, motorcycle drivers and pilots mentioned above as well as people who wear protective garments such as fire fighters etc.

Various "personal air conditioning systems" for air conditioning an individual by especially designed garments are known in the art. Such air conditioning systems can be classified as liquid-based systems or gas-based systems. Liquid-based systems employ closed system circulation of cooled liquids and cool by touch. Gas-based systems cool by gas expansion. Both methods employ a system of tubing passing in the proximity of the wearer body for conveying the liquid or gas either in a closed or in an open system.

Existing personal conditioning systems suffer from a number of drawbacks. Conditioning systems which are using liquid circulation in a closed system might be dangerous if upon malfunctioning, liquids stop circulating. In such a case, the isolated liquid layer would heat up and prevent the body from "breathing", thus worsening users physical and psychological situation, which may end in a "heat-shock". Furthermore, liquid systems are susceptible to liquid leakage which might cause inconvenience to the wearer and damage to equipment.

Another main drawback associated with tubing-based systems, for conveying either gas or liquid, is that upon wearer movements tubes might fold and block passage of fluids. On the other hand, if the tubes are made of relatively rigid material for preventing the tubes from folding, then the tubing system imparts the garment rigidity which might limit the wearer's movements. Wearer convenience considerations also limits the diameter of the tubing that can be used, therefore a relatively high pressure in needed in order to obtain reasonable flow rate. Another drawback of tubing systems is that with time tubes tend to get plugged due to precipitant accumulation on the tubing walls.

Accordingly, it is the object of the present invention to provide a personal air conditioning system, which overcomes the drawbacks of known systems.

SUMMARY OF THE PRESENT INVENTION

It is the object of the present invention to provide means for delivering conditioned-air to individuals in specified vehicles, where traditional air conditioning units are not practical. Such means should be of low power consumption, lightweight, and with practically no effect on vehicle's performance.

Yet it is another object of the present invention to provide such a personal air conditioning which is economical and has minimal moving parts.

Yet it is another object of the present invention to provide such personal air conditioner, which is environmentally friendly where no cooling liquids or gases are used.

In accordance with the above objectives, the present invention provides an air conditioning garment for an individual in need of air conditioning, especially useful for racecar drivers, motorcycle drivers, pilots and the like.

The air conditioning garment comprises an inner layer of a three-dimensional netting structure enclosed between two layers of substantially air-impermeable fabric wherein one of said two fabric layer, being the layer facing the body is having a plurality of openings directed toward predetermined locations on said body. The garment is further having an inlet opening with connection means for connecting the inner layer to a source of air at a predetermined temperature. Said connection means is preferably having automatic quick disconnecting means. The garment may further comprise an additional layer of a loosely woven or knitted fabric which does not prevent air free passage connected to the impermeable layer facing the wearer's body. Preferably, the thickness of the three dimensional net is in the range of 2 to 10 mm and its density is in the range of 5 to 30% v/v. Preferably, the cell formed by the netting are in the range of 1 to 8 mm. The three-dimensional netting is fabricated from any fiber or a filament. The air source supplying air to the garment can be any air source known in art such as an air conditioning unit, an air blower, etc. Preferably the air source supplies air at a rate of 3 to 20 cfm. The air-conditioned garment can be any garment or a part thereof for covering any part of the body, such as a vest, a headwear, etc. The air conditioning garment can further comprise an outlet opening connected to the inlet opening of another air conditioning garment. According to one embodiment of the present invention is a detachable lining attached to the inner side of a second garment wherein the second garment may be any garment such as a helmet, a shirt, etc.

The present invention further provides a method for air conditioning an individual person in need of air conditioning. The method comprising the following: (a) providing the person with a garment comprising an inner layer of a three dimensional mesh sandwiched between two layers of material impermeable or semi-impermeable to air wherein one of said two layers, being the layer facing said individual body is having a plurality of openings directed to predetermined locations on said individual's body (b) connecting said inner layer of three-dimensional mesh to a source of air at a predetermined temperature for directing streams of conditioned air to said predetermined locations.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENTS

The present invention overcomes the disadvantages of the prior art by providing a novel technology for air conditioning garments, especially designed for individuals under extreme environmental conditions, such as in small aircraft, closed-cockpit racecars and other vehicles, and for people wearing protective garments, like fire-fighters, workers exposed to environmental hazards, etc.

The garments of the present invention are designed to deliver conditioned-air to individuals in specified vehicles, where traditional air conditioning units are not practical. While traditional air conditioning systems air condition a room or a defined space, the present invention air-conditions the individual person in need of air conditioning, primarily on the upper portion of his/her body by specially designed garments. This allows for significant reductions in power consumption, weight and cost. The technology employed by the present invention is environmentally friendly where no special cooling liquids or gases are used. The air conditioning garments of the present invention are lightweight and unlike other personal air-conditioners available today, do not employ tubing system.

The air conditioning garments of the present invention are made from especially designed cloth, which comprises an inner layer of three-dimensional network. Conditioned air supplied to the garment by an external air source moves freely throughout the cloth and is directed through a plurality of outlet openings (nozzles) to predetermined locations on the body of the person wearing the garment. The location of the openings is designed so as to allow the most efficient air conditioning by directing streams of conditioned air to the most temperature sensitive locations on the person body or to those body areas which suffer mostly from excess or loss of heat. The use of predetermined openings in the garment to cool (or heat) particular locations of the wearer's body allows the air-source to be relatively small and lightweight and minimize the power consumption demand. Furthermore, the use of the three dimensional net can replace "cushions" and other padding which are used to absorb impact in helmets and other garments.

Figure 1:
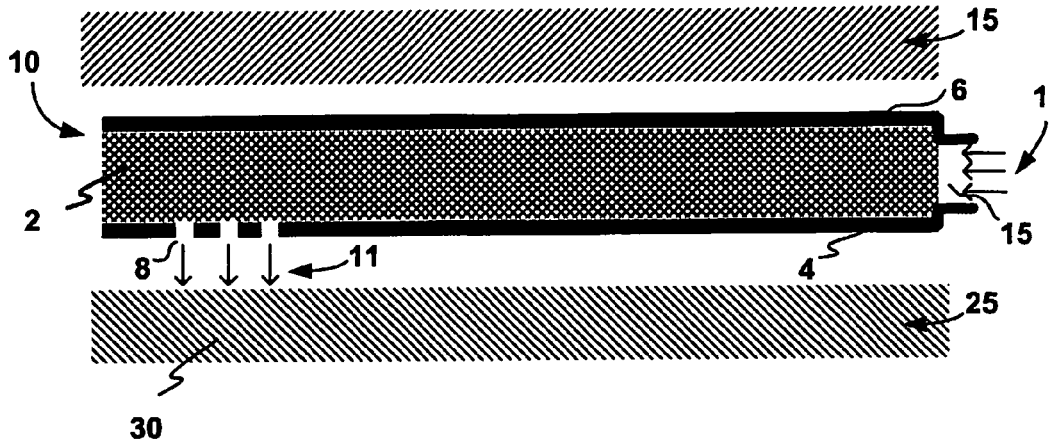
FIG. 1 is a cross section of the cloth of the present invention.

Referring now to FIG. 1, there is shown a cross section of the cloth, designated 10, from which garments of the present invention are fabricated. Cloth 10, which is the core of the present invention, comprises an intermediate layer 2 of three-dimensional netting sandwiched between two layers, designated 4 and 6, of fabric, which is impermeable or semi-impermeable to air. In the example shown here layer 4 is the interior surface of the cloth facing the person body (designated 25) while layer 6 is directed away from the body. Layer 4 facing the wearer's body 25 is having a plurality of outlet openings 3 directed to predetermined locations 30 on said individual's body. For enhancing the wearer comfort, layer 4 is optionally covered by another fabric layer (not shown) which is loosely woven, for example a two dimensional cotton net, which does not prevent the free flow of air from holes 8 toward the body. This additional layer is aimed at preventing direct contact of the body with impermeable layer 4 and for allowing perspiration absorption. Layers 4 and 6 are connected at the garment circumference by air-tight means such as sewing, gluing or any other fabric air-tight connecting means to ensure that air does not escape from the garment rim.

Conditioned air, designated 1, is supplied to a garment made of cloth 10 through an opening 15. The conditioned air is distributed uniformly through mesh layer 2 to fill the whole space between layers 4 and 6. The three dimensional netting structure of inner layer 2 ensures free passage of air throughout layer 2 under all conditions, thus allowing a complete freedom of movement to the wearer of the garment without any risk of blocking the air passage. The inner netting allows free air flow, even when the fabric-layer is folded, twisted or when it is tightened to the wearer's body by, for example, seat belts. Excess air leaves cloth 10 through openings 8 by streams 11 which are directed toward predetermined location 30 on body 25. Air inlet 15 can be located between the two impermeable layers 4 and 6 as illustrated. In this case layers 4 and 6 are tightened around the inlet. Alternatively an opening can be cut through one of the impermeable layers, preferably through outer layer 6, and inlet 15 is connected to the opening by an air-tight connection.

The use of the special designed garments of the present invention allows for air conditioning by two independent mechanisms. The first main mechanism is by directing streams of conditioned-air to predetermined locations of the individual body. However, since the whole garment is filled with conditioned air, a secondary effect of air conditioning by contact is achieved as well.

In accordance with the present invention, layer 2 can be of any flexible fabric having a three-dimensional netting structure woven or knitted from any fiber, filament or yarn such as plastic, nylon, acrylic, cotton, fiberglass, etc. Preferably layer 2 is of 2–10 mm thickness. The density of the three dimensional netting is preferably in the range of 5 to 30% v/v (mass volume per total volume). Although flexible, the three dimensional netting has internal rigidity and elasticity which maintains its structure and keeps it from collapsing under pressure. The three dimensional netting comprising layer 2 can be a commercially available fabric, such as for example the 3D packaging net distributed by 3M, can be especially fabricated for the purpose of the present invention or can be a natural material such as a dried sponge or loofah. The cells formed by the net can be of a regular pattern such as in a regularly woven or knitted fabric or irregular such as in a natural dried loofah. Preferably the skeleton cells formed by the 3D netting are of dimension in the range of 1 to 8 mm.

Layers 4 and 6 can be made of any impermeable or semi-impermeable fabric such as a polyamide or other synthetic polymer sheet, or a closed woven fabric processed by impregnation, vulcanization or lamination in order to impart it impermeability. Alternatively, layers 4 and 6 can be made of natural impermeable material such as leather.

For using under very high temperature, such as by fire-fighters, layers 2, 4 and 6 comprise fire-resistant materials.

Since the air-source supplying conditioned air needs to supply only relatively small volumes of air because of the localized application of the air streams, it can be relative small unit having low weight and low power consumption. The air source can be a simple air-pump, a blower, a vortex tube connected to an air compressor or any other small air-conditioning unit. The air-conditioning unit can be located anywhere in the vehicle wherein its outlet is connected to the inlet of the garment by means of a flexible pipe.

It will be easily appreciated that the flow rate of conditioned air needed in order to achieve a desired air conditioning effect depends on the body area to be air-conditioned, on the garment features and on the ratio between the input and output area. The present invention offers a very high flexibility in designing air-conditioning garments, allowing optimal design tailored to a specific purpose while minimizing the energy consumption. By manipulating various parameters of the garment, i.e., the mesh inner volume, the number and size of the openings and the degree of impermeability of the two enclosing layers, it is possible to achieve the maximal air conditioning efficacy for a given flow rate. In general, since the garment is an open system, applying an air flow into the garment results in an inside pressure which is equal to or slightly exceeds atmospheric pressure. The air is applied into the garment through inlet 15 and leaves the garment through output holes 8. Inlet 15 is having a cross section area which is always larger than the total area of the outlet openings. The ratio between the input area and the total area of output holes determines the output flow rate. The relatively low density of layer 2 ensures that the pressure inside the garment is substantially equal throughout the garment, thus that the outlet streams of conditioned air through nozzles 8 located at different distances from the inlet are substantially of equal rate. Typical rates of air supply are in the range of a few cfm (cubic feet/meter) and up to about 20 cfm. Typically, a flow rate of 10–15 cfm is needed for a body garment while a flow rate of 5–8 cfm is sufficient for a head garment.

Various air conditioning garments, or garment parts, such as suits, pants, shirts, vests caps, socks, gloves, hats, caps, helmets and part thereof can be fabricated from cloth 10 to be worn by persons under extreme environmental temperature.

Alternatively, cloth 10 can be used as a lining for an already made or especially designed garment (designated 15 in FIG. 1). When used as a lining, it can be either permanently attached to the inner surface of the garment, or preferably it can be a detachable lining such as to allow connecting and removing according to need. When used as an inner lining, the inner surface of the garment itself can serve as the exterior layer of the lining (i.e., layer 6 in FIG. 1). Thus the lining itself can comprise only the mesh layer and the interior layer (i.e. layer 4 of FIG. 1) with openings for directing streams of conditioned air toward predetermined location on wearer's body. The garment of the present invention need not cover a large body area and can be designed to cover only the body areas for which air streams are applied. In particular, cloth 10 can be cut to form garments parts for partially covering the upper torso or to be inserted in helmets to be used by motorcycle drivers, racecar drivers and pilots.

Figure 2A:
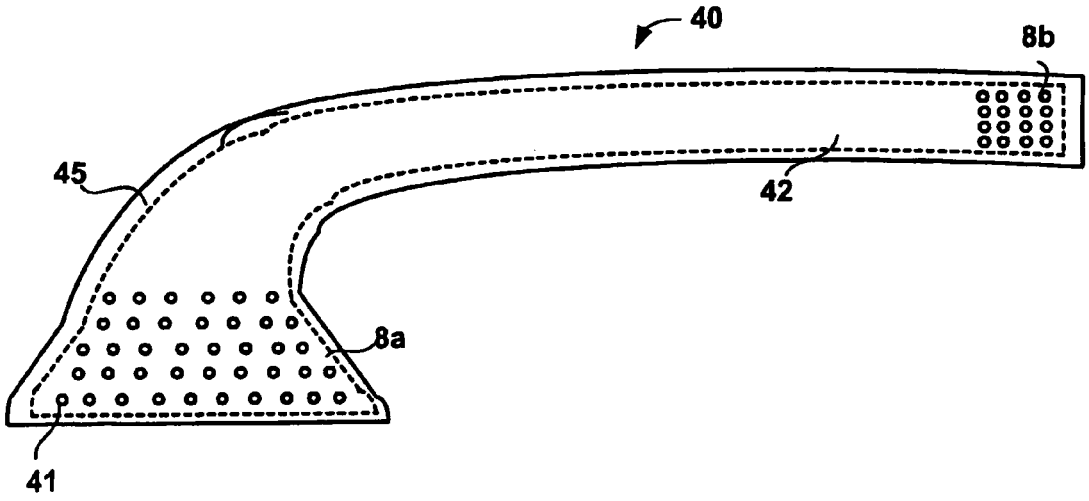
FIG. 2 illustrate a garment piece to be worn around the upper torso in accordance with one embodiment of the present invention.

Referring now to FIGS. 2 and 3, there are shown a few examples of air conditioning garments in accordance with the present invention. FIG. 2A illustrates a garment, designated 40, designed to air-condition the upper torso of an individual by applying streams of air on the chest and the lower back. FIG. 2A shows the garment shape when spread out. FIGS. 2B and 2C give a frontal and back view respectively of the garment when worn around the upper body under a shirt 50. Garment 40, made of cloth 10 (as described in FIG. 1) is shaped to encircle the upper part of the wearer. The garment comprises a wider part 41 to be placed against the chest and a narrow tail-like part 42 that encircles the upper torso and ends at the wearer lower back as best seen in FIGS. 2B and 2C. Conditioned air is supplied to garment 40 through opening 15 and comes out through outlet holes 8*a* and 8*b* directed toward the chest and the back of the wearer respectively. The air-tight rim 45 of garment 40, where layers 4 and 6 are connected by air connected means, ensures that air does not leak from undesired locations. A typical air flow needed for garment 40 having a typical inlet cross section of about: 7 $cm^2$ and typical total outlet area of 2.4 $cm^2$, is in the range of 10 to 15 cfm. Garment 40 can be either permanently attached to the inner side of shirt 50, or preferably garment 40 is a detachable lining. When detachable, garment 40 can be connected to shirt 50 by means such as Velcro or can be suspended on inner suspenders sewn to the shirt, such that it can be easily removed when not needed.

Figure 3A:
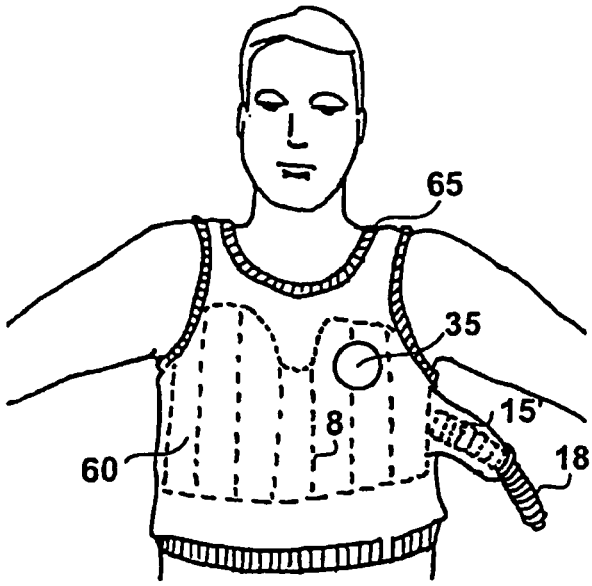
FIG. 3 illustrate another air conditioning garment in accordance with the present invention.

FIG. 3 illustrates yet another garment in accordance with the present invention designed to cool the chest of the wearer and having an additional opening 35 for connecting to an air-conditioning helmet (not shown). Thus, a single air source can provide conditioned air for air-conditioning the wearer body as well as his head. FIG. 3A illustrates an air conditioning garment, designated 60, cut to cover the chest of the wearer to be worn under undershirt 65. The interior layer (4 in FIG. 1) is perforated to forms rows of openings 8 for directing streams of air toward the wearer chest. Air is supplied to garment 60 by means of flexible pipe 18 connected to the outlet of an air source through is having through a sleeve-like inlet 15' which envelopes a connector connected to flexible pipe 18. Garment 65 is further having an air outlet opening 35, of cross section smaller than the cross section of inlet 15'. Outlet opening 35 can be connected to another pipe for directing conditioned air to another air-conditioning garment such as a head cover, for cooling the head.

Figure 3B:
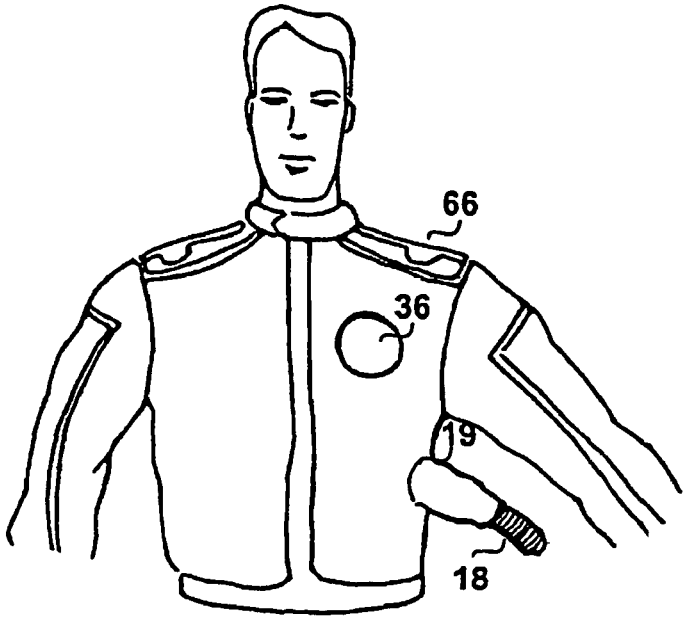

FIG. 3B illustrates a jacket 66 suitable to be worn over garment piece 65. Jacket 66 is having an opening 19 for threading sleeve 15' and an opening 36 for allowing the connection of the inlet and outlet tubes, respectively.

Figure 4A:
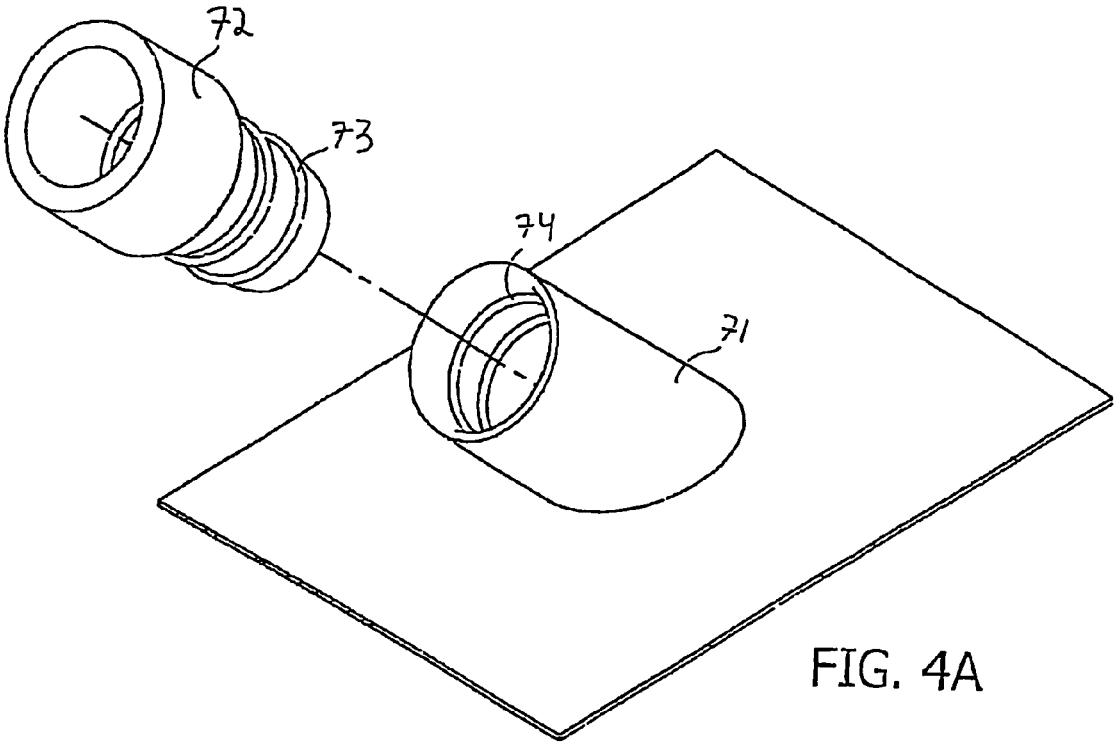
FIG. 4 depict one embodiment of a connector having a quick disconnecting for connecting a tube to a garment of the present invention.
Figure 4B:
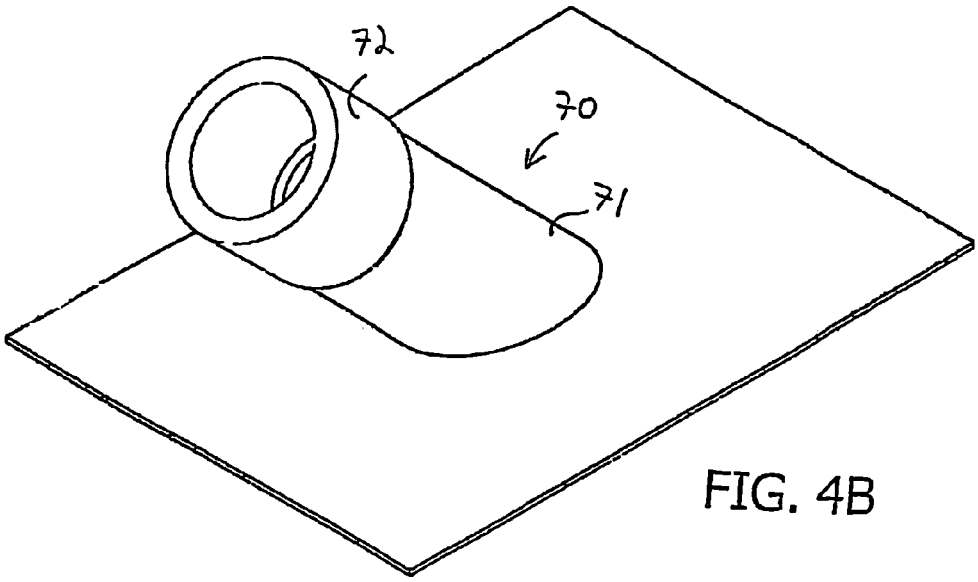

Turning now to FIG. 4, there is illustrated a special connector for connecting the outlet tube of an air source to the garment of the present invention. The connector is designed to allow quick connecting of the tube to the garment and in particular to allow automatic quick disconnecting under a predetermined load. Automatic quick disconnection is crucial in order to disconnect the wearer of the garment from the air source unit upon emergency conditions, such as accidents for preventing possible trapping. The connector is designed such as to provide automatic disconnection under a certain load or stress. FIGS. 4A and 4B depict one embodiment of a connector having automatic quick disconnection, in its disconnected and respectively. Connector 70 comprising a female part 71 and a male part 72. Preferably the female part is connected to the garment while the male part is connected or the extension of the outlet tube of the air source. Part 72, being of more rigid material than part 71, is having protruding rings 73 around its external surface to fit the corresponding recess rings 74 around the internal surface of part 71. Quick connection is achieved by inserting part 72 into part 71. The pressure widens part 72 and protrusions 73 are pushed into recessions 74. Likewise, when opposite forces are exerted on parts 71 and 72 such that they are pulled to opposite directions, protrusions 73 cause part 71 to widen, hence releasing part 72. Parts 71 and 72 can be fabricated from rubber or plastic of different elasticity. By varying the elasticity difference between the two parts and the rings thickness and depth, it is possible control the load under which an automatic disconnection will take place.

It will be appreciated by persons skilled in the art that alternative connectors having quick disconnecting are possible. For example the female part may have an internal spring ring that is pushed into a recess when the male part is inserted and is pressed against the male to hold it in place. When opposite forces are exerted on the two parts, the spring ring is pushed into the recess and the two parts are disconnected.

It will be appreciated by persons skilled in the art that the present invention is not limited to what has been particularly shown and described hereinabove. Rather the scope of the present invention is defined only by the claims, which follow.

The invention claimed is:

1. An air conditioned garment for air conditioning an individual wearing said garment, the garment comprising:

an inner layer of an air-permeable three-dimensional netting structure enclosed between two layers of substantially air-impermeable fabric, wherein one of said two fabric layers, being the layer facing said individual's body when said individual is wearing said garment, includes a plurality of openings directed toward predetermined locations on said individual's body, and wherein said garment includes an inlet opening connector configured to connect the inner layer to a source of air at a predetermined temperature.

2. The air-conditioned garment of claim 1 wherein the thickness of the three dimensional net is in the range of 2 to 10 mm.

3. The air-conditioned garment of claim 1 wherein, the density of the three dimensional net is in the range of 5 to 30% v/v.

4. The air-conditioned garment of claim 1 wherein the cells formed by the three dimensional netting are in the range of 1 to 8 mm.

5. The air-conditioned garment of claim 1 wherein said three-dimensional netting is fabricated from a fiber or a filament selected from the group consisting of nylon fibers, cotton fibers and fiberglass.

6. The air-conditioned garment of claim 1 wherein said air source supplies air at a rate of 3 to 20 cfm.

7. The air-conditioned garment of claim 1 wherein said air source is an air conditioning unit.

8. The air-conditioned garment of claim 1 wherein said air source is an air blower.

9. The air-conditioned garment of claim 1 wherein said garment is a vest or a part thereof.

10. The air-conditioned garment of claim 1 wherein said garment is a headwear or a part thereof.

11. The air conditioning garment of claim 1 wherein said individual is a racecar driver in a closed cockpit racecar or a pilot in a closed cockpit aircraft.

12. The air-conditioned garment of claim 1 wherein said garment is a detachable lining attached to the inner side of a second garment.

13. The air-conditioned garment of claim 12 wherein the second garment is a helmet.

14. The air-conditioned garment of claim 12 wherein the second garment is a shirt.

15. The air-conditioned garment of claim 1 wherein the substantially impermeable layer facing the wearer body is covered by a loosely woven or knitted fabric which does not prevent free passage of air streams.

16. The garment of claim 1 wherein the connector is further configured to quickly and automatically disconnect from the source of air.

17. The air conditioning garment of claim 1 further comprising an outlet opening connected to the inlet opening of another air conditioning garment.

18. An air conditioning garment for air conditioning an individual wearing said garment comprising, in combination with any garment, an inner lining, said inner lining comprising:

a layer of air-permeable three-dimensional mesh, at least one layer of air-impermeable or semi-air-impermeable fabric laminated to said layer of three-dimensional mesh, said fabric layer is facing said individual's body and having a plurality of openings directed to predetermined locations on said individual's body, wherein said inner layer is connected to a source of air at a predetermined temperature.

19. The air conditioning garment of claim 18 wherein said lining is a detachable lining.

20. A method for air conditioning an individual person in need of air conditioning, said method comprising:

providing said person with a garment comprising an inner layer of an air-permeable three dimensional mesh sandwiched between two layers of material impermeable or semi-impermeable to air wherein one of said two layers, being the layer facing said individual body is having a plurality of openings directed to predetermined locations on said individuals body; and connecting said inner layer of air-permeable three-dimensional mesh to a source of air at a predetermined temperature, whereby streams of conditioned air are directed to said predetermined locations.

21. An air conditioning garment for air conditioning an individual wearing said garment as described hereinabove.

* * * * *